US010125765B2

(12) United States Patent
Jesel

(10) Patent No.: US 10,125,765 B2
(45) Date of Patent: Nov. 13, 2018

(54) FLUID PUMP WITH TWO PUMPS

(71) Applicant: Jesel, Inc., Lakewood, NJ (US)

(72) Inventor: Daniel H. Jesel, Lakewood, NJ (US)

(73) Assignee: JESEL, INC., Lakewood, NJ (US)

( * ) Notice: Subject to any disclaimer, the term of this patent is extended or adjusted under 35 U.S.C. 154(b) by 50 days.

(21) Appl. No.: 14/961,090

(22) Filed: Dec. 7, 2015

(65) Prior Publication Data

US 2016/0160858 A1 Jun. 9, 2016

Related U.S. Application Data

(60) Provisional application No. 62/088,895, filed on Dec. 8, 2014.

(51) Int. Cl.

| | |
|---|---|
| ***F01C 1/18*** | (2006.01) |
| ***F03C 2/00*** | (2006.01) |
| ***F03C 4/00*** | (2006.01) |
| ***F04C 15/00*** | (2006.01) |
| ***F04C 2/18*** | (2006.01) |
| ***F04C 11/00*** | (2006.01) |
| ***F04C 2/08*** | (2006.01) |
| *F04C 15/06* | (2006.01) |
| *F04C 23/00* | (2006.01) |

(52) U.S. Cl.

CPC ..... *F04C 15/0061* (2013.01); *F04C 2/08* (2013.01); *F04C 2/084* (2013.01); *F04C 2/18* (2013.01); *F04C 11/001* (2013.01); *F04C 15/06* (2013.01); *F04C 23/001* (2013.01); *F04C 2210/206* (2013.01)

(58) Field of Classification Search

CPC ..... F04C 2/08; F04C 23/001; F04C 15/06; F04C 15/0061; F04C 11/001; F04C 2210/206; F04C 2/084; F04C 2/086

USPC ..... 418/5, 9, 206.1–206.9

See application file for complete search history.

(56) References Cited

U.S. PATENT DOCUMENTS

| | | | | |
|---|---|---|---|---|
| 1,771,863 A * | 7/1930 | Rudolf | F04C 2/126 | 418/204 |
| 3,179,383 A * | 4/1965 | Knedlik | A23G 9/20 | 366/262 |
| 4,195,480 A * | 4/1980 | Shelby | F04C 11/00 | 418/200 |
| 4,729,727 A * | 3/1988 | Aarestad | F04C 2/086 | 418/18 |
| 5,639,230 A * | 6/1997 | Lechner | F04C 2/084 | 418/150 |

FOREIGN PATENT DOCUMENTS

| | | | |
|---|---|---|---|
| DE | 2439358 A1 * | 2/1976 | F04C 15/0057 |

* cited by examiner

*Primary Examiner* — Theresa Trieu
(74) *Attorney, Agent, or Firm* — Shuttleworth & Ingersoll, PLC; Timothy J. Klima

(57) ABSTRACT

A fluid pump system for an engine includes a transmission acting as a first pump and a second pump. In one embodiment, the first pump is a scavenge pump and the second pump is a pressure pump with the transmission being a gear set for altering a drive ratio between a transmission input drive and an input drive of the second pump, thereby allowing additional control of a speed of the second pump in comparison to the engine. The transmission, acting as a scavenge pump, can provide a scavenge pump function to an oil pan of the engine, returning engine oil that is present there from both normal drain back and acceleration/deceleration forces.

22 Claims, 2 Drawing Sheets

FLUID PUMP WITH TWO PUMPS

This application claims priority to U.S. provisional patent application 62/088,895 filed Dec. 8, 2014, the entirety of which is incorporated by reference herein.

Disclosed is a multiple stage gear reduction wet sump oil pump for domestic racing engines.

BACKGROUND

Typical US type race engines utilizing wet sump oil pumps, (pump in pan) effectively use the basic design supplied by OEM engine manufacturers. These pumps are typically driven at ½ engine speed by various drive devices powered by the camshaft. These OEM engines typically have a max rpm range of 5,000-7,000 rpms and thus, the pumps typically have a max rpm range of 2500-3500 rpms (i.e., ½ the engine range). When used in high rpm (8-9000) race engines, engine builders find the OEM style oil pumps pump oil at excessive pressures, causing among other issues, oil cavitation, foaming and power pumping loss. Presently, this is addressed by regulating the pump's output with a bypass valve, which in most cases, engages at between 2000-3,000 engine rpms.

Additional issues with wet sump oil pump systems is oil starvation due to high "G" acceleration and deceleration forces that move the oil in the pan so violently that the pump pickups are often uncovered and can no longer supply oil, causing bearing failures.

BRIEF SUMMARY

A fluid pump system for an engine includes a transmission acting as a first pump and a second pump. In one embodiment, the first pump is a scavenge pump and the second pump is a pressure pump with the transmission being a gear set for altering a drive ratio between a transmission input drive and an input drive of the second pump, thereby allowing additional control of a speed of the second pump in comparison to the engine. The transmission, acting as a scavenge pump, can provide a scavenge pump function to an oil pan of the engine, returning engine oil that is present there from both normal drain back and acceleration/deceleration forces.

The fluid pump can include a first shaft for connecting to a drive mechanism for driving the fluid pump; a first housing including a first fluid input port and a first fluid output port and a transmission positioned in an interior of the first housing. The transmission can include a first driving gear connected to the first shaft to be driven by the first shaft; and a first driven gear, with the first driving gear engaging the first driven gear to drive the first driven gear, the first driving gear and first driven gear together having a first drive ratio. The transmission also acts as a first fluid pump for pumping fluid from the first fluid input port through the interior of the first housing and out the first fluid output port. A second housing includes a second fluid input port and a second fluid output port. A second fluid pump is positioned in an interior of the second housing, the pressure stage pump operatively connected to the transmission to be driven by the transmission at the first drive ratio for pumping fluid from the second fluid input port through the interior of the second housing and out the second fluid output port.

It is a particular object to provide a fluid pump featuring the characteristics described herein, with further advantageous developments of the fluid pump being described below. This stated object is not to be interpreted as the only object or as limiting other objects.

BRIEF DESCRIPTION OF THE DRAWINGS

Further objects and advantages of this invention will become more apparent and more readily appreciated from the following detailed description of the present fluid pump, taken in conjunction with the accompanying drawings, of which.

DESCRIPTION

In one embodiment, the presently described oil pump system includes a 2-stage wet sump oil pump having a scavenge pump and a pressure pump and a gear reduction gear set (transmission), which transmission also functions as the scavenge pump. The transmission allows additional control of the speed of the oil pump in comparison to the engine, and in one embodiment, enables the pressure stage pump to run at ½ speed of the normal pump described above, that is, at ¼ of the speed of the engine. This reduction in speed of the pressure pump reduces the typical high rpm shortcomings of a typical oil pump. Other gear ratios can also be used. The transmission, acting as a scavenge pump, provides a scavenge pump function to the oil pan, returning engine oil that is present there from both normal drain back and acceleration/deceleration forces. The scavenged oil is returned through the pump body and pumped to the portion of the oil pan where the pickup of the pressure pump can collect the oil for pressurized lubrication duty. In a typical engine, the scavenge oil pump will scavenge oil from the front of the oil pan and return it to the rear of the oil pan where the pressure pump pickup is located, although these locations can be altered as desired.

The present oil pump can be mounted in an original location for the typical oil pump, often in the rear of the oil pan. The present oil pump can be mounted onto the rear main cap with an adapter plate. In one embodiment, the adapter plate can include an adjustable pressure bypass valve, which can be accessed externally of the oil pan without having to remove or drop the oil pan, so that engine builders can set the oil pressure bypass level while the engine is mounted on a dyno, test bed or in a chassis. The oil pump package is of very compact size, providing the gear reduction, 2 stage pump, bypass circuit and a large hi efficiency filter all in the same space as a typical single stage OEM oil pump.

The present oil pump has several benefits. By reducing the speed of the pressure pump with the transmission, the pressure pump provides a better quality oil feed and oil conditions. The scavenge oil pump incorporated into the housing provides for desirable second stage oil collection from other locations in the oil pan than served by the typical pressure pump pickup. Use of the transmission as the scavenge oil pump provides a compact design which allows fitment of the present oil pump into typical oil pans and oil pan depths in use today. The remotely accessed bypass adjustment allows for adjustment from the exterior of the engine without having to remove or drop the oil pan.

Figure 1:
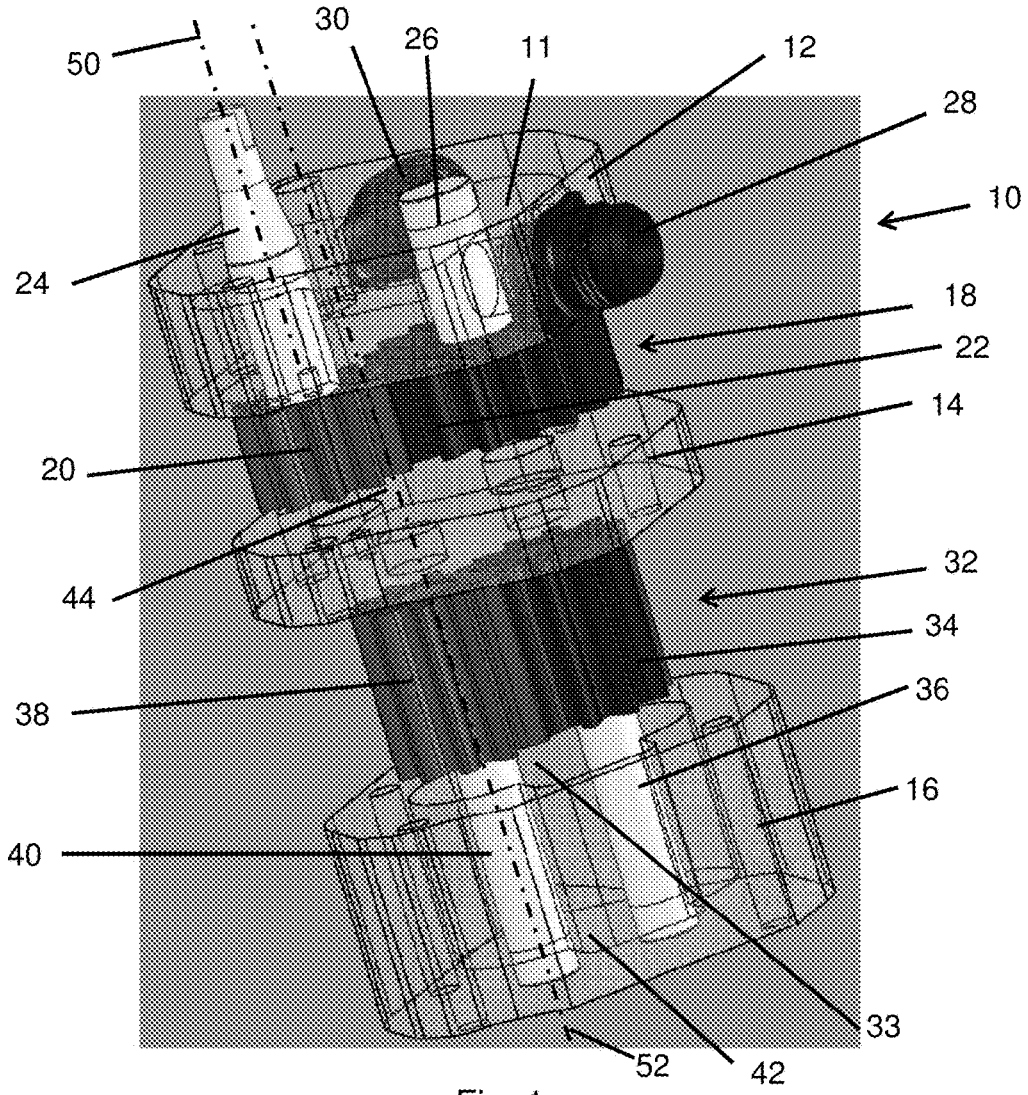
FIG. 1 shows an exploded schematic view of a fluid pump.
Figure 2:
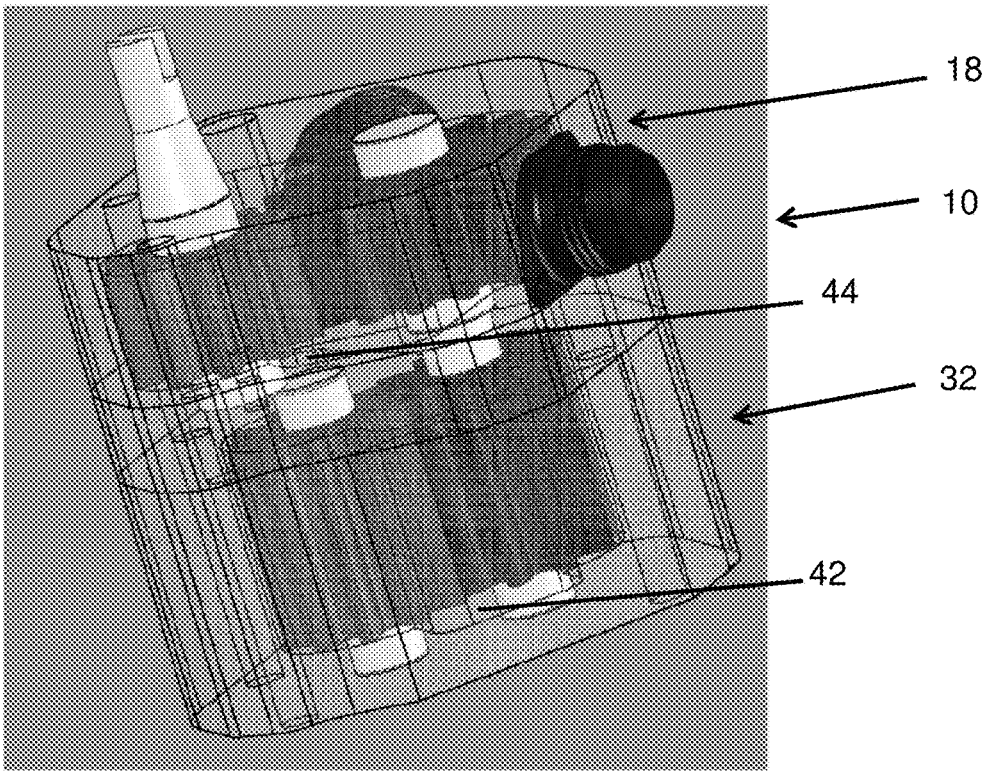
FIG. 2 shows an assembled schematic view of the fluid pump of FIG. 1.

The present oil pump 10 is shown in an exploded view in FIG. 1 and in an assembled view in FIG. 2. The oil pump includes a scavenge housing 12, a separator plate 14 and a pressure housing 16. Positioned in an interior 11 of scavenge housing 12 is transmission 18, including driving gear 20 and driven gear 22. Driving gear 20 is mounted on drive shaft 24 (first shaft—connecting portion) for connecting to a drive mechanism, typically from a camshaft. Driven gear 22 is mounted on a shaft 26 (second shaft). Thus, the drive shaft 24 is a transmission input and shaft 26 is a transmission output for transmission 18. The gearing ratio (first drive ratio) between driving gear 20 and driven gear 22 can be altered from 1:1 to any ratio desired. As discussed previously, that ratio can be 1:2 to provide that driven gear 22 rotates at ½ speed of driving gear 20. Other ratios can also be used. The transmission 18 also simultaneously acts as a scavenge pump, where oil is input into the scavenge pump at port 28, pumped by the interaction of gears 20 and 22, and output at port 30, or vice-versa, depending on the rotation of drive shaft 24. The oil can be scavenged from portions of the oil pan which are not served well by the pressure pump pickup and the scavenged oil can be returned to the area of the pressure pump pickup.

A pressure pump stage 32 includes driving gear 34 mounted on shaft 36 and driven gear 38 mounted on shaft 40 (third shaft), with the gears positioned in the interior 33 of housing 16 and a gear ratio (third drive ratio) between the driving gear 34 and the driven gear 38 can be 1:1. An axis 50 of drive shaft 24 and an axis 52 of shaft 40 can be offset from one another. See FIG. 1. Driven gear 22 is operatively connected to driving gear 34 to drive driving gear 34 (second drive ratio, which can be 1:1). This operative connection can be through shaft 26 and shaft 36 being a common shaft (second shaft), engaging shaft 26 with shaft 36, through engaging driven gear 22 with driving gear 34, or through some other mechanism. Because driven gear 22 operates at the gear ratio of transmission 18 with respect to driving gear 20, driving gear 34, through the operative connection with driven gear 22, also operates at the same gear ratio with respect to driving gear 20 as driven gear 22. For example, if the gear ration between gears 20 and 22 is 1:2, the gear ratio between gears 20 and 34 is also 1:2. Thus, through this arrangement, the pressure pump 32 can be driven at a lower speed than the drive shaft 24. Since, as noted above, 1 any ratio desired can be used, the pressure pump 32 can also be driven at a higher speed than the drive shaft 24. Oil is pumped by the interaction of gears 34 and 38 from a second fluid input port 42 and out a second fluid output port 44 into the engine pressurized oil system, as is known. In one embodiment, the oil is pumped from pressure pump 32 through cavities in the housings and into the engine pressurized oil system through existing oil passages in the engine, although other arrangements can also be used.

The oil pump can is held together by fasteners in the assembled state such that the scavenge housing 12 is part of a first portion of the overall housing and the pressure housing 16 is part of a second portion of the overall housing.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims. All language of distinction and disparagement with respect to certain features is intended to indicate a lack of preference for those features, but not to exclude such from the scope of the disclosure entirely unless otherwise indicated. All methods described herein can be performed in any suitable order unless otherwise indicated herein or otherwise clearly contradicted by context. Various features of the various embodiments disclosed herein can be combined in different combinations to create new embodiments within the scope of the present disclosure. Any ranges given herein include any and all specific values within the range and any and all ranges within the given range.

What is claimed is:

1. A fluid pump for an engine, comprising:

a first shaft for connecting to a drive mechanism for driving the fluid pump;

a first housing including a first fluid input port and a first fluid output port;

a transmission positioned in an interior of the first housing; the transmission including:

a first driving gear connected to the first shaft to be driven by the first shaft;

a first driven gear, the first driving gear engaging the first driven gear to drive the first driven gear, the first driving gear and first driven gear together having a first drive ratio different than 1:1;

the transmission also being a first fluid pump for pumping fluid from the first fluid input port through the interior of the first housing and out the first fluid output port;

a second housing connected to the first housing and including a second fluid input port and a second fluid output port;

a second fluid pump positioned in an interior of the second housing, the second fluid pump operatively connected to the first driven gear to be driven by the transmission at the first drive ratio for pumping fluid from the second fluid input port through the interior of the second housing and out the second fluid output port;

wherein the second fluid pump includes a second driving gear and a second driven gear; the second driving gear engaging the second driven gear to drive the second driven gear;

wherein the first driven gear is operatively connected to the second driving gear in second drive ratio of 1 to 1.

2. The fluid pump of claim 1, wherein the first drive ratio of the first driving gear to first driven gear is 1 to greater than 1.

3. The fluid pump of claim 2, wherein the first driven gear is operatively connected to the second driving gear in a coaxial arrangement.

4. The fluid pump of claim 3, and further comprising a second shaft coaxially mounting the first driven gear and the second driving gear.

5. The fluid pump of claim 4, wherein the second shaft drivingly connects the first driven gear and the second driving gear.

6. The fluid pump of claim 5, wherein the first fluid pump is a scavenge pump.

7. The fluid pump of claim 6, wherein the second fluid pump is a pressure pump.

8. The fluid pump of claim 7, and further comprising a separator plate positioned between the first housing and the second housing to separate the interior of the first housing from the interior of the second housing.

9. The fluid pump of claim 8, and further comprising a third shaft mounting the second driven gear, wherein the first shaft has an axis and the third shaft has an axis and the axis of the third shaft is offset from the axis of the first shaft.

10. The fluid pump of claim 9, wherein the first drive ratio of the first driving gear to first driven gear is 1 to 2.

11. The fluid pump of claim 10, wherein a third drive ratio of the second driving gear to second driven gear is 1 to 1.

12. The fluid pump of claim 8, and further comprising a third shaft mounting the second driven gear, wherein the first shaft has an axis and the third shaft has an axis and the axis of the third shaft is offset from the axis of the first shaft.

13. The fluid pump of claim 1, wherein the first fluid pump is a scavenge pump.

14. The fluid pump of claim 1, wherein the second fluid pump is a pressure pump.

15. The fluid pump of claim 1, wherein the first driven gear is operatively connected to the second driving gear in a coaxial arrangement.

16. The fluid pump of claim 15, and further comprising a second shaft coaxially mounting the first driven gear and the second driving gear, wherein the second shaft drivingly connects the first driven gear and the second driving gear.

17. A fluid pump for an engine, comprising:

a first connecting portion for connecting to a drive mechanism for driving the fluid pump;

a housing including a first portion including a first fluid input port and a first fluid output port;

a transmission positioned in an interior of the first portion; the transmission including:

a first driving gear operatively connected to the first connecting portion to be driven by the first connecting portion;

a first driven gear, the first driving gear engaging the first driven gear to drive the first driven gear, the first driving gear and first driven gear together having a first drive ratio different then 1:1;

the transmission also being a first fluid pump for pumping fluid from the first fluid input port through the interior of the first portion and out the first fluid output port;

the housing including a second portion including a second fluid input port and a second fluid output port;

a second fluid pump positioned in an interior of the second portion, the second fluid pump operatively connected to the first driven gear to be driven by the transmission at the first drive ratio for pumping fluid from the second fluid input port through the interior of the second portion and out the second fluid output port;

wherein the second fluid pump includes a second driving gear and a second driven gear; the second driving gear engaging the second driven gear to drive the second driven gear;

wherein the first driven gear is operatively connected to the second driving gear in second drive ratio of 1 to 1.

18. The fluid pump of claim 17, wherein the first drive ratio is such that the second fluid pump is driven at a speed lower than the first fluid pump by the transmission.

19. The fluid pump of claim 17, wherein the first drive ratio is such that the second fluid pump is driven at a speed higher than the first fluid pump by the transmission.

20. A fluid pump for an engine, comprising:

a housing including a first portion;

a transmission positioned in an interior of the first portion; the transmission including:

an input for connecting to a drive mechanism for driving the fluid pump;

an output driven by the input at a drive ratio different then 1:1;

the transmission also being a first fluid pump for pumping fluid through the interior of the first portion;

the housing including a second portion;

a second fluid pump positioned in an interior of the second portion, the second fluid pump operatively connected to the transmission output to be driven by the transmission at the drive ratio for pumping fluid through the interior of the second portion;

wherein the second fluid pump includes a second driving gear and a second driven gear; the second driving gear engaging the second driven gear to drive the second driven gear;

wherein the first fluid pump includes a first driving gear and a first driven gear; the first driven gear is operatively connected to the second driving gear in second drive ratio of 1 to 1.

21. The fluid pump of claim 20, wherein the drive ratio is such that the second fluid pump is driven at a speed lower than the first fluid pump by the transmission.

22. The fluid pump of claim 20, wherein the drive ratio is such that the second fluid pump is driven at a speed higher than the first fluid pump by the transmission.

* * * * *